US009190259B2

(12) United States Patent
Doi et al.

(10) Patent No.: US 9,190,259 B2
(45) Date of Patent: Nov. 17, 2015

(54) DISCHARGE LAMP AND DISCHARGE LAMP APPARATUS

(75) Inventors: Masahiro Doi, Imabari (JP); Makoto Deguchi, Imabari (JP); Osamu Shirakawa, Imabari (JP); Syuhei Abe, Imabari (JP); Keisuke Nakazato, Imabari (JP); Masahiro Oki, Imabari (JP); Kousuke Ueda, Imabari (JP); Hajime Murakami, Imabari (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 281 days.

(21) Appl. No.: 13/825,464

(22) PCT Filed: Aug. 8, 2011

(86) PCT No.: PCT/JP2011/068079

§ 371 (c)(1),
(2), (4) Date: Jun. 18, 2013

(87) PCT Pub. No.: WO2012/056787

PCT Pub. Date: May 3, 2012

(65) Prior Publication Data

US 2013/0271026 A1 Oct. 17, 2013

(30) Foreign Application Priority Data

Oct. 25, 2010 (JP) ..... 2010-238612

(51) Int. Cl.

| | |
|---|---|
| ***H05B 41/24*** | (2006.01) |
| ***H01J 61/30*** | (2006.01) |
| ***H01J 5/54*** | (2006.01) |
| ***H01J 61/56*** | (2006.01) |

(52) U.S. Cl.
CPC . *H01J 61/30* (2013.01); *H01J 5/54* (2013.01); *H01J 61/56* (2013.01)

(58) Field of Classification Search
None
See application file for complete search history.

(56) References Cited

U.S. PATENT DOCUMENTS

| | | | | |
|---|---|---|---|---|
| 4,563,730 | A | 1/1986 | Saito | |
| 6,031,323 | A | 2/2000 | Behr et al. | |
| 6,111,359 | A * | 8/2000 | Work et al. | 315/56 |
| 6,259,192 | B1 | 7/2001 | Becker et al. | |
| 6,294,861 | B1 | 9/2001 | Mochiduki et al. | |

(Continued)

FOREIGN PATENT DOCUMENTS

| | | | |
|---|---|---|---|
| EP | 0082998 | A1 | 7/1983 |
| EP | 0786791 | A1 | 7/1997 |

(Continued)

OTHER PUBLICATIONS

Notification of Reasons for Refusal issued in corresponding Japanese Patent Application No. 2012-540717 mailed Mar. 18, 2014.

(Continued)

*Primary Examiner* — Cassandra Cox
(74) *Attorney, Agent, or Firm* — Banner & Witcoff, Ltd.

(57) ABSTRACT

There is provided a discharge lamp of an embodiment includes a burner having a light emitting part, and a disk-shaped flange which is capable of holding the burner so that the light emitting part is positioned at a front end side of the flange. The flange includes a resin part formed at an edge of the flange, and a metal part formed to be embedded in the resin part.

5 Claims, 11 Drawing Sheets

(56) References Cited

U.S. PATENT DOCUMENTS

| | | | | |
|---|---|---|---|---|
| 7,602,112 | B2 * | 10/2009 | Peeters et al. | 313/318.07 |
| 2005/0099141 | A1 * | 5/2005 | Godyak et al. | 315/248 |
| 2008/0224616 | A1 | 9/2008 | Linssen | |
| 2010/0053989 | A1 | 3/2010 | Gerhard et al. | |
| 2011/0032723 | A1 | 2/2011 | Gerhard et al. | |
| 2011/0037374 | A1 | 2/2011 | Gerhard et al. | |
| 2011/0133663 | A1 * | 6/2011 | Stockwald | 315/246 |

FOREIGN PATENT DOCUMENTS

| | | | |
|---|---|---|---|
| EP | 0991096 | A1 | 4/2000 |
| JP | 58-096606 | U | 6/1983 |
| JP | H09-213208 | A | 8/1997 |
| JP | 2000-260542 | A | 9/2000 |
| JP | 2003-123630 | A | 4/2003 |
| JP | 2003-297226 | A | 10/2003 |
| JP | 2005-011712 | A | 1/2005 |
| JP | 2007-519197 | A | 7/2007 |
| JP | 2007-323986 | A | 12/2007 |
| JP | 2008-153145 | A | 7/2008 |
| JP | 2009-087705 | A | 4/2009 |
| WO | 2008-078421 | A1 | 7/2008 |
| WO | 2008-110969 | A2 | 9/2008 |
| WO | 2009-130640 | A2 | 10/2009 |
| WO | 2009-130654 | A1 | 10/2009 |

OTHER PUBLICATIONS

Extended European Search Report issued in corresponding European Patent Application No. 11835928.0 mailed Mar. 7, 2014.

* cited by examiner

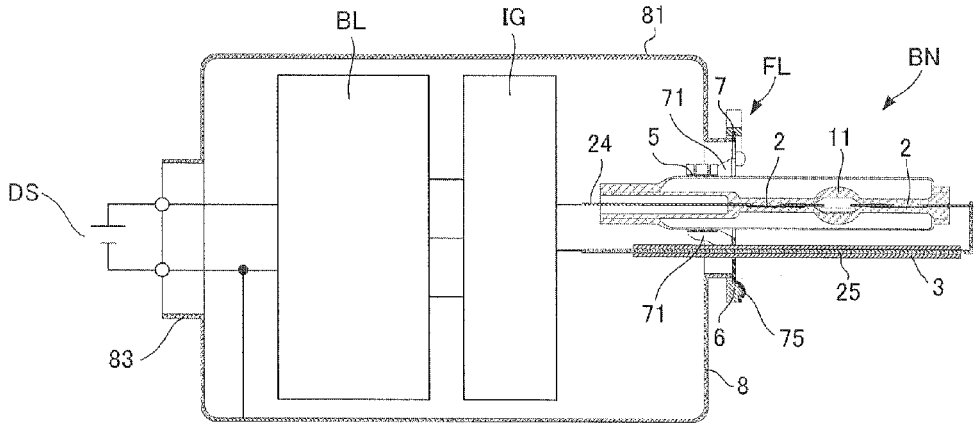

FIG. 15

| NO | PROTUBERANCE PART AND METAL BAND | PULSE POLARITY | KIND OF OUTER TUBE GAS | NOISE | START ABILITY | DETERMINATION |
|---|---|---|---|---|---|---|
| 1 | NOT CONNECTED TO GROUND | POSITIVE | ATMOSPHERE | × | × | × |
| 2 | CONNECTED TO GROUND | POSITIVE | ATMOSPHERE | ○ | × | × |
| 3 | NOT CONNECTED TO GROUND | POSITIVE | $N_2$ | × | ○ | × |
| 4 | CONNECTED TO GROUND | POSITIVE | $N_2$ | ○ | × | × |
| 5 | NOT CONNECTED TO GROUND | POSITIVE | Ne | × | ○ | × |
| 6 | CONNECTED TO GROUND | POSITIVE | Ne | ○ | △ | △ |
| 7 | NOT CONNECTED TO GROUND | POSITIVE | Ar | × | ○ | × |
| 8 | CONNECTED TO GROUND | POSITIVE | Ar | ○ | ○ | ○ |
| 9 | NOT CONNECTED TO GROUND | POSITIVE | Kr | × | ○ | × |
| 10 | CONNECTED TO GROUND | POSITIVE | Kr | ○ | △ | △ |
| 11 | NOT CONNECTED TO GROUND | POSITIVE | Xe | × | ○ | × |
| 12 | CONNECTED TO GROUND | POSITIVE | Xe | ○ | △ | △ |

FIG. 16

| PRESENCE OR ABSENCE OF CONNECTION OF METAL BAND TO GROUND | POLARITY OF HIGH-VOLTAGE PULSE INPUT WHENSTARTING | NOISE | SPREAD OF BARRIER DISCHARGE INSIDE OUTER TUBE | STARTABILITY |
|---|---|---|---|---|
| ABSENCE | POSITIVE | × | ○ | ○ |
| ABSENCE | NEGATIVE | × | ○ | ○ |
| PRESENCE | POSITIVE | ○ | × | × |
| PRESENCE | NEGATIVE | ○ | ○ | ○ |
FIG. 20
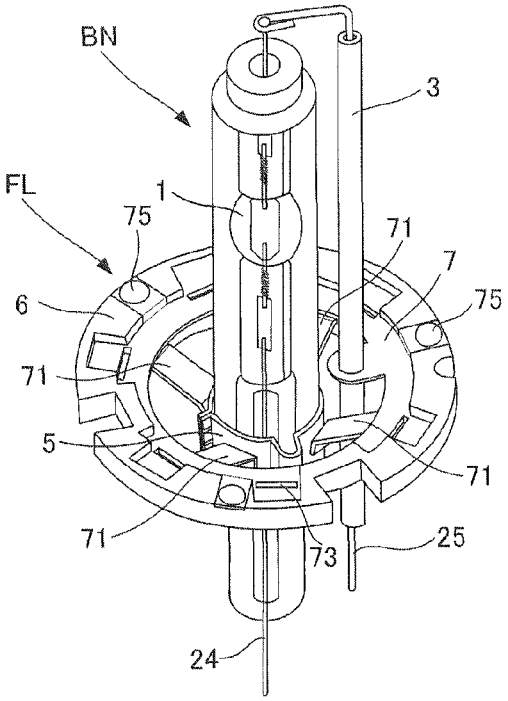
FIG. 21A
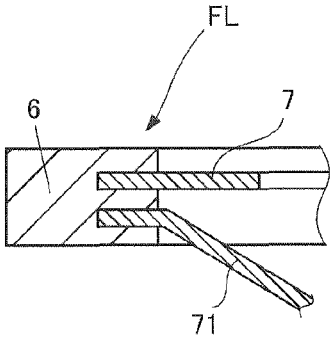
FIG. 21B

DISCHARGE LAMP AND DISCHARGE LAMP APPARATUS

TECHNICAL FIELD

Embodiments of the present invention relate to a discharge lamp which is used in a vehicle headlight of an automobile or the like and a discharge lamp apparatus.

BACKGROUND ART

A discharge lamp used in a headlight of an automobile is configured of a burner and a socket made from resin as disclosed in PTL 1 and PTL 2. The burner is a double-tube structure comprising a light emitting part which emits the light during lighting and is held in the socket so that the light emitting part is positioned at a front end side of the socket.

CITATION LIST

Patent Literature

[PTL 1] JP-A-2003-297226
[PTL 2] JP-A-2007-323986
[PTL 3] International Publication No. WO2009/130654
[PTL 4] International Publication No. WO2008/110969
[PTL 5] International Publication No. WO2009/130640

SUMMARY OF INVENTION

Technical Problem

Here, in recent years, in order to make a lamp more compact, there is a need for the distance between the light emitting part and the socket to be set closer than that of the conventional lamp. However, when such a design is performed, since more heat or ultraviolet rays emitted by the light emitting part during the lighting reaches the socket than that of the related art lamp, a problem occurs in which a flange provided at the front end side of the socket is degraded. Since gas occurs when the flange is degraded, a problem develops in which a glass portion of the burner or a lens part of a headlight device is clouded by the gas.

In addition, as disclosed in PTL 3 to PTL 5, the problem described above may be solved if the portion corresponding to the flange of the conventional socket is configured of entirely of metal parts. However, even though the problem of the deterioration of the flange is solved by the method described above, since the flange structure is complicated, new problems such as an increase in the number of parts, difficulty in assembly, decrease in dimensional accuracy and strength reduction (or to be weight) may occur.

Embodiments provide a discharge lamp and a discharge lamp apparatus which may suppress deterioration of a flange with a simple structure.

Solution to Problem

A discharge lamp of an embodiment includes a burner having a light emitting part, and a disk-shaped flange capable of holding the burner so that the light emitting part is positioned on the front end part of the flange. The flange has a resin part formed at an edge of the flange, and a metal part formed so as to be embedded in the resin part.

BRIEF DESCRIPTION OF DRAWINGS

FIG. 15 is a view explaining simplified circuit connection of the discharge lamp.

FIG. 16 is a view explaining noise and startability when applying a high-voltage pulse with a positive polarity illustrated in FIG. 17, in twelve types of lamps in which a type of gas enclosed in an outer tube, and presence or absence of a ground connection of a protuberance part and a metal band are changed.

FIG. 20 is a view explaining noise and startability when conditions of a metal band and a high-voltage pulse are changed.

FIG. 21A is a view explaining a discharge lamp of a sixth embodiment of the present invention and FIG. 21B is an enlarged cross-sectional view of a main portion in FIG. 21A.

DESCRIPTION OF EMBODIMENTS (First Embodiment)

Hereinafter, a discharge lamp of an embodiment of the present invention is described with reference to the drawings.

Figure 1:
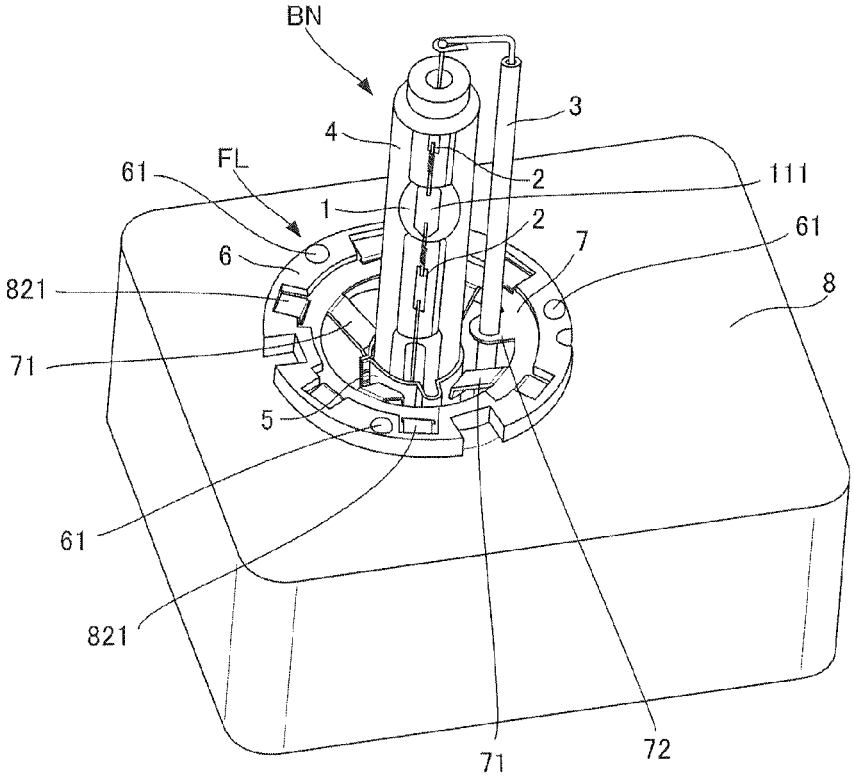
FIG. 1 is a view explaining a discharge lamp of a first embodiment of the present invention.
Figure 2:
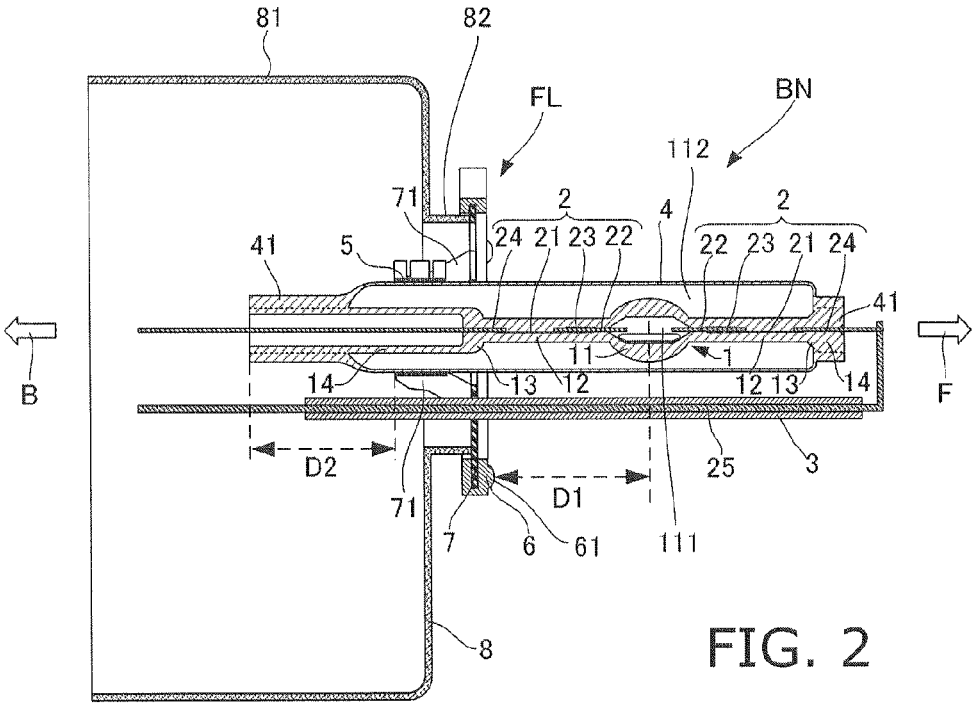
FIG. 2 is a view explaining a cross-section of the discharge lamp of FIG. 1.
Figure 3:
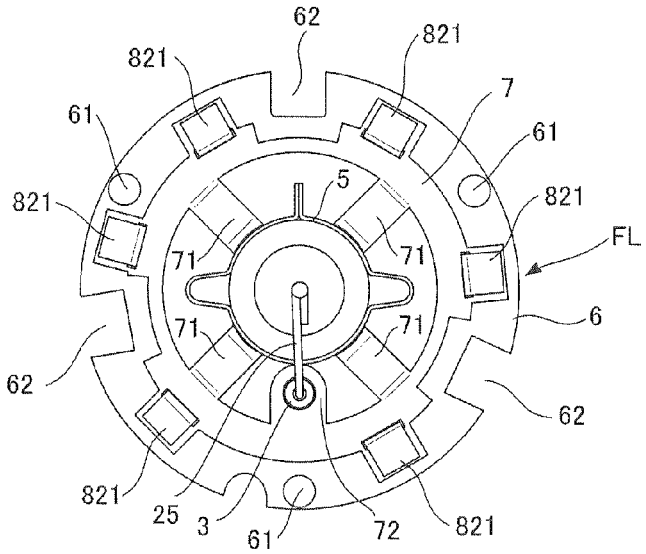
FIG. 3 is a view explaining a state where the discharge lamp of FIG. 1 is viewed from the front end side.

FIG. 1 is a view explaining a discharge lamp of the first embodiment of the present invention, FIG. 2 is a view explaining a cross-section of the discharge lamp of FIG. 1 and FIG. 3 is a view explaining a state where the discharge lamp of FIG. 1 is viewed from the front end side.

In addition, in the embodiment, for the sake of convenience, description is given in which the direction which is forward when attached to an automobile as shown by an arrow F in FIG. 2 is referred to as a front end and the opposite direction thereof in the direction of an arrow B is referred to as a back end.

The discharge lamp of the embodiment is, for example, an HID (High Intensity Discharge) lamp used in a headlight apparatus of the automobile and includes a burner BN and a flange FL.

As shown in FIGS. 1 and 2, the burner BN is a double-tube structure and an inner tube 1 is disposed therein. The inner tube 1 is an elongated shape and a light emitting part 11, which emits the light during lighting, is formed near the center thereof. The light emitting part 11 is a substantially elliptical shape. Plate-like seal parts 12 are formed at both ends thereof and cylindrical parts 14 are continuously formed at both ends via boundary parts 13. As described above, since the inner tube 1 includes the light emitting part and becomes hot, it is preferably configured of a material including a light-transmitting ability and heat-resisting ability such as quartz glass.

A discharge space 111, of which the center is substantially cylindrical and both ends are tapered, is formed at the inside of the light emitting part 11. When used for the headlight of the automobile, the volume of the discharge space 111 is 10 $mm^3$ to 30 $mm^3$ and preferably 15 $mm^3$ to 25 $mm^3$. A discharge medium is sealed in the discharge space 111. The discharge medium includes a metal halide and a noble gas but does not include mercury, which is a so-called mercury-free configuration.

The metal halides are composed of halides such as sodium, scandium, zinc and indium. As the halogen coupled to the metal halides, iodine is the most suitable, however, bromine, chlorine or the like may be combined. In addition, the present invention is not limited to the combination of the metal halides and halides of tin or cesium may be added.

The noble gas is composed of xenon. The noble gas is able to adjust the charged pressure depending on the purpose thereof. For example, in order to improve the properties such as total luminous flux, it is preferable that the charged pressure be approximately 10 atm or more, particularly 13 atm or more at room temperature (25° C.). The upper limit is approximately 20 atm under the present condition in production. In addition, as the noble gas, neon, argon, krypton, and the like or combination thereof may be used other than xenon.

Figure 22:
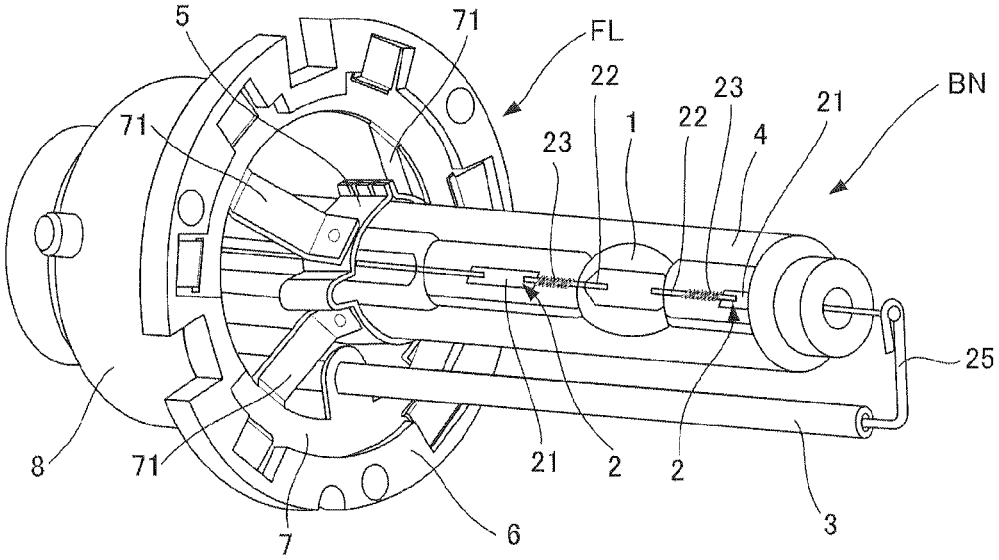
FIG. 22 is a view explaining a first modification example of the discharge lamp.

A pair of seal parts 12 are provided to sandwich the light emitting part 11. An electrode mount 2 is sealed in each of the seal parts 12. As shown in FIG. 2 and FIG. 22 described below, the electrode mount 2 is configured of a metal foil 21, an electrode 22, a coil 23 and a lead wire 24.

The metal foil 21 is, for example, is a thin metal plate made of molybdenum and the plate-like surface thereof is disposed to be parallel to the plate-like surface of the seal part 12.

The electrode 22 is, for example, an electrode made of a so-called thoriated tungsten in which tungsten is doped with thorium oxide. One end of the electrode 22 is superposed and connected to an end portion of the metal foil 21 at the light emitting part 11 side. Each of the other ends (the front ends) of a pair of electrodes 22 is opposed to hold a predetermined distance between the electrodes in the discharge space 111. As the distance between the electrodes, in the case of the headlight of the automobile, it is preferable that the distance be 3.5 mm to 4.5 mm in appearance.

For example, the coil 23 is a metal wire made of doped tungsten and is wound helically about a shaft portion of the electrode 22 which is sealed to the seal part 12.

For example, the lead wire 24 is a metal wire made of molybdenum. One end thereof is superposed and connected to the metal foil 21 opposite side with respect to the light emitting part 11 and the other end is extended to the outside of the inner tube 1 along a tube axis. Among them, for example, one end of an L-shaped support wire 25 made of nickel is connected to the lead wire 24 extended to the front end side of the lamp by laser welding. For example, a sleeve 3 made of ceramic is mounted on a portion which is parallel to the tube axis at the support wire 25.

A cylindrical outer tube 4 is provided at the outside of the inner tube 1 configured described above in concentric with the inner tube 1. The connection between the inner and the outer tubes is performed by welding the outer tube 4 to near the cylindrical part 14 of the inner tube 1 and forming welded parts 41 at both ends. Thus, a space 112, which is held air-tight, is formed between the inner tube 1 and the outer tube 4. A kind of gas or mixed gas selected from neon, argon, xenon and nitrogen is sealed in the space 112 at a pressure of 0.3 atm or less. In addition, it is preferable that the outer tube 4 be made of a material of which the thermal expansion coefficient is near that of the inner tube 1 and which has ultraviolet blocking ability, such as quartz glass with addition of oxide of titanium, cerium, aluminum or the like.

A metal band 5 is provided at the back end side of the burner BN described above. The metal band 5 is, for example, a band in which a metal plate made of stainless steel is disposed along the outer peripheral surface of the outer tube 4 and is fixed to the burner BN by welding both ends thereof together.

Figure 4A:
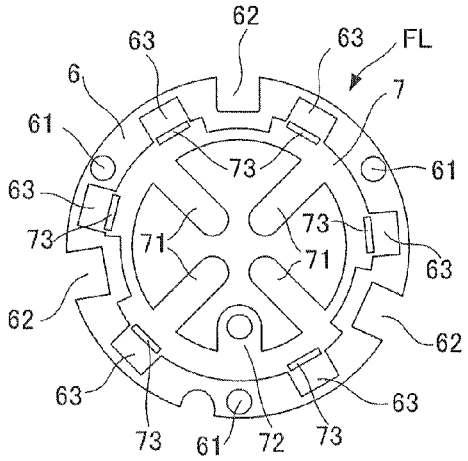
FIGS. 4A and 4B are views explaining a flange.
Figure 4B:
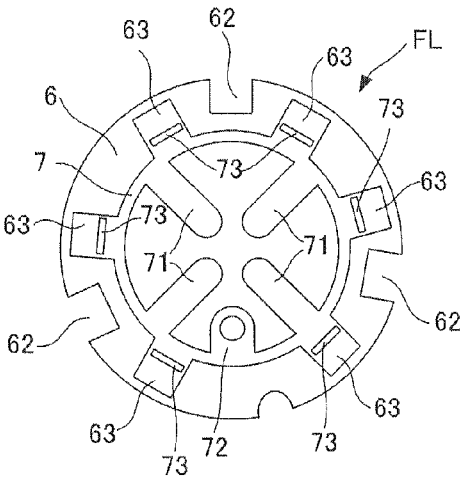

The flange FL is disposed near the metal band 5. FIG. 4A is a plan view of the front end side of the flange FL and FIG. 4B is a plan view of the back end side of the flange FL.

The flange FL is a disk shape and, for example, the diameter thereof is approximately 31 mm, the thickness is approximately 2.5 mm, and the flange FL is configured of a resin part 6 and a metal part 7.

For example, the resin part 6 is molded of resin such as PPS (polyphenylenesulfide) and PEI (polyetherimide) and is positioned at the edge of the flange FL. The flange FL has a protuberance part 61, a cutout part 62 and a recess 63.

The protuberance part 61 is a projection which is provided at the front end side of the resin part 6 and three protuberance parts 61 are formed, for example, at 120 degree intervals in the circumferential direction of the flange FL. The protuberance part 61 is a portion serving as a base point for measuring the dimensions. A distance D1 shown in FIG. 2 from the front end of the protuberance part 61 to the center between the electrodes in the light emitting part 11 is defined as the LCL (Light Center Length) of the discharge lamp.

The cutout part 62 is formed at the outer edge side of the resin part 6 and, for example, three cutout parts 62 are irregularly formed. The recess 63 is a recess provided at the front end side of the resin part 6 and, for example, six recesses 63 are formed at 60 degree intervals.

Figure 5:
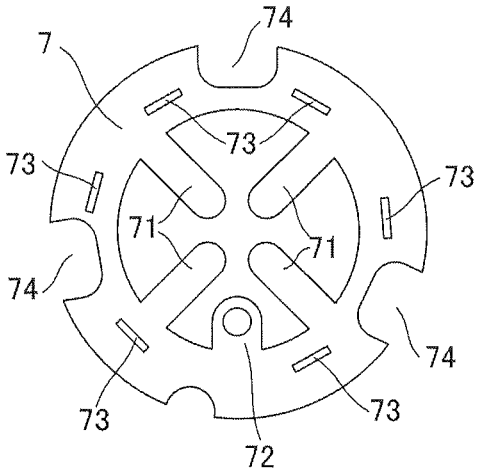
FIG. 5 is a view explaining a metal part.

The metal part 7 is, for example, a metal plate made of stainless steel or the like and is formed to be embedded in the resin part 6. FIG. 5 illustrates the shape of the metal part 7 before embedded in the resin part 6. The metal part 7 has a protruding piece part 71, sleeve holding part 72, a hole part 73 and a cutout part 74.

Figure 7:
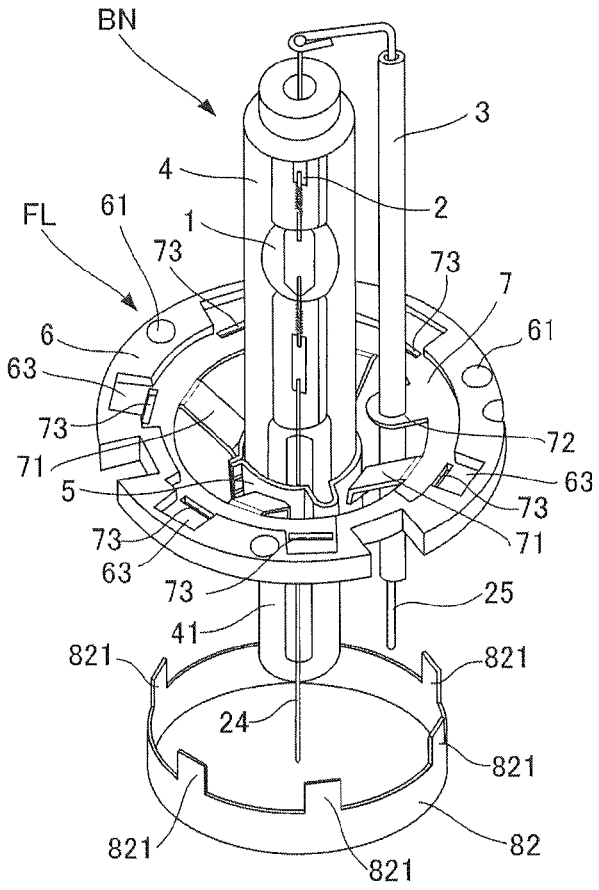
FIG. 7 is a view explaining connection of the flange and a ring.

The protruding piece part 71 is a protruding piece which is formed to protrude in the center direction (the center axis) of the metal part 7 and four protrusion parts 71 are formed, for example, at 90 degree intervals. As shown in FIGS. 1 and 7, the protruding piece parts 71 are bent obliquely in the direction of the back end and hold the metal band 5 from four sides at the front end in a state of the discharge lamp.

The sleeve holding part 72 is made of a metal plate formed to protrude to the center of the metal part 7. A circular hole is formed at a center portion thereof so that the sleeve 3 is inserted into the hole.

The hole part 73 is a through hole formed near the recess 63 of the resin part 6 and, for example, six hole parts 73 are formed at 60 degree intervals. The cutout part 74 is a cutout formed at the outer periphery side of the metal part 7 and three cutout parts 74 are formed to correspond to the cutout parts 62 of the resin part 6.

Figure 6:
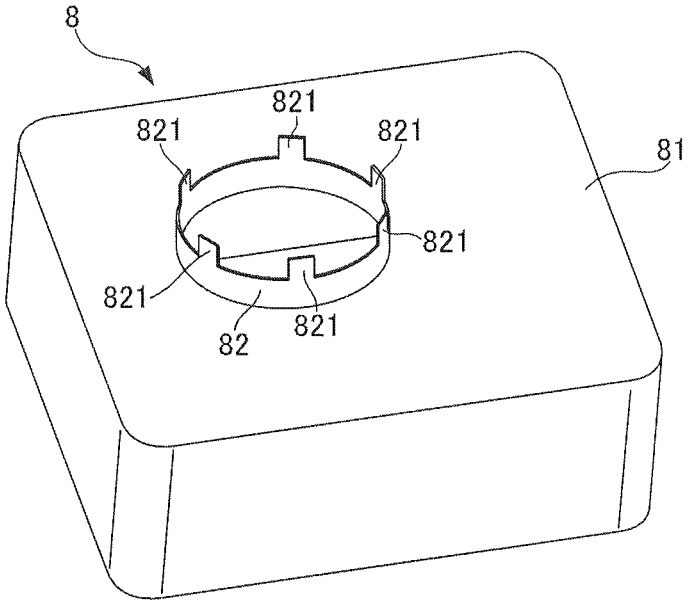
FIG. 6 is a view explaining a base.

As shown in FIGS. 1 and 2, a base 8 is disposed at the back end side of the flange FL. The base 8 is, for example, made of a conductive material such as stainless steel, iron, nickel and aluminum, and as shown in FIG. 6, includes a case part 81 and a ring 82.

A housing is disposed inside the base 8 and a lighting circuit (not shown) to start and stable light the discharge lamp is disposed inside the housing. Specifically, a resin case, which includes a start lighting circuit or a stable lighting circuit having a circuit element or a metal terminal such as a transformer, or a capacitor inside thereof, is disposed. Ends of the lead wire 24 and the support wire 25, which are extended in the back end direction more than the flange FL, are connected to the metal terminal of a lighting circuit device.

The ring 82 is a cylindrical tube formed at the front end side of the case part 81 and six protrusion parts 821 are formed for example, at 60 degree intervals at the front end side thereof. The protrusion parts 821 are used to connect the ring 82 and the flange FL.

Specifically, the ring 82 and the flange FL can be fixed to each other by bending (the state shown in FIGS. 1 and 3) protrusion portions of the protrusion parts 821 so as to be accommodated in the recesses 63 after the protrusion parts 821 are inserted into the hole parts 73 of the metal part 7 shown in FIG. 7. In addition, the fixing may be reinforced by the laser welding or the like at the superimposed portion between the bent protrusion parts 821 and the metal part 7. Otherwise, the protrusion parts 821 may be fixed to the metal part 7 by welding without bending after the protrusion parts 821 are inserted into the hole parts 73.

Here, a lamp (a comparative example) having a flange made of resin in which the LCL (Light Center Length) D1 is shortened to 18.0 mm from 27.1 mm of the related art, and the lamp (the embodiment) of the embodiment described above in which D1 is 18.0 mm were mounted on a discharge lamp apparatus used in the headlight device for the automobile including a hollow reflector and a lens. Then, a power of approximately 25 W when stable and approximately 55 W when starting which is twice the electric power when stable or higher were input and then the lighting was performed continuously for 1000 hours.

As a result, in the lamp of the comparative example, it was confirmed that the surface of the front end side of the flange was degraded and discolored, and cloud occurred at the inside of the lens of the headlight device, however, in the lamp of the embodiment, it was confirmed that the flange was not discolored and the cloud did not occur unlike the comparative example.

In the lamp of the comparative example, the defects might be caused by that the LCL was short, the distance between the light emitting part that was a heat source and the flange was short and when the flange became a high temperature and then the ultraviolet light was irradiated to the resin portion of the flange.

Meanwhile, in the lamp of the embodiment, no defects occurred because the ultraviolet light was not nearly irradiated to the resin part 6 of the flange FL. In other words, since the resin part 6 formed at the edge of the flange FL was hidden at the back side of the reflector and the ultraviolet light became almost completely not irradiated from the light emitting part 11 to the resin part 6 when mounting on the discharge lamp apparatus, it was considered that the gas or the like did not occur due to the degradation of the resin part 6, even though the temperature of the flange FL became high similarly to the comparative example.

In addition, dimensional accuracy and strength of the flange FL are improved by forming the edge of the flange FL with the resin. In other words, since the flange FL is a portion held in the reflector, high dimensional accuracy and strength are required and since an edge portion, which is to be held, is able to be formed by the resin formation, the flange FL, which has high dimensional accuracy and strength, and is easily produced, can be realized.

In addition, the protuberance part 61 is also formed of the resin. The protuberance part 61 is a portion which rotates while coming into contact with a contact surface 914 of a reflector 91 described below with reference to FIGS. 9 to 11, when the lamp is attached to the reflector.

When the base 8, of which the weight is, for example, 50 g or more if the lighting circuit is also included, is tightly attached to the reflector 91, the lamp is rotated while the protuberance part 61 is strongly pressed against the contact surface 914. When the protuberance part 61 is made of metal, there is concern that scratching or the like may occur on the contact surface 914 of the reflector 91, however, when the protuberance part 61 is made of the resin, such scratching can be prevented.

In addition, since the sleeve holding part 72 is integrally formed with the metal part 7, assembling accuracy of the sleeve 3 can be improved. In other words, an intermediate portion of the elongated sleeve 3 is held by the sleeve holding part 72 so that the sleeve 3 and the burner BN can be kept substantially parallel to each other.

In addition, two or more protruding piece parts 71 holding the burner BN are integrally formed with the metal part 7 so that variation of the distance between the burner BN and the sleeve 3 can be suppressed.

In the embodiment, the flange FL is configured of the resin part 6 and the metal part 7, the resin part 6 is formed at the edge of the flange FL and the metal part 7 is formed to be embedded in the resin part 6. Accordingly, since the ultraviolet light is not nearly irradiated from the light emitting part 11 to the resin part 6 when mounted on the discharge lamp apparatus, the phenomenon, in which the gas or the like occurs due to the degradation of the resin part 6 and the lens is clouded, can be suppressed. In addition, since the edge of the flange FL is made of the resin, the flange FL, which has high dimensional accuracy and strength and is easily produced, and of which the reflector does not become scratched, can be realized.

In addition, in the embodiment of the present invention, a further desirable effect may be obtained when combined with a structure described below.

A distance D2 (shown in FIG. 2) between an end portion of the back end side of the burner BN and the back end side of the metal member (the metal band 5 in the embodiment) that is the nearest to the end portion of the back end side of the burner BN is 10 mm or more. If the distance D2 is 10 mm or more, occurrence of pulse leakage can be suppressed. The pulse leakage is caused by using the metal member as the flange FL. When the metal member is used as the flange FL, since the distance between the flange FL and the support wire 25 is close, high-voltage pulse is easily leaked via the metal band 5, the metal part 7 or the protruding piece part 71 when starting.

It was confirmed that when high-voltage pulse, in which the rising time was 200 nsec and output was 23 kV, was applied to the discharge lamp by an igniter, pulse leakage easily occurred when the distance D2 was 5 mm, 7 mm and 9 mm, respectively and pulse leakage did not occur when the distance D2 was 10 mm, 12 mm and 15 mm respectively.

Accordingly, it is preferable that the distance D2 be 10 mm or more. In addition, the nearest metal member from the end portion of the back end side of the burner BN maybe the metal part 7 or the protruding piece part 71.

Figure 11A:
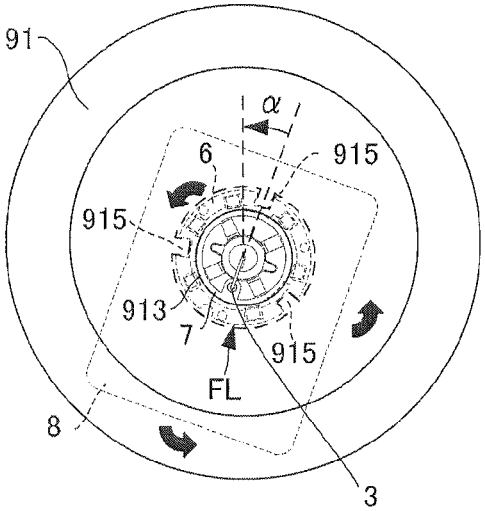
FIGS. 11A and 11B are views explaining connection of a discharge lamp to the reflector.
Figure 11B:
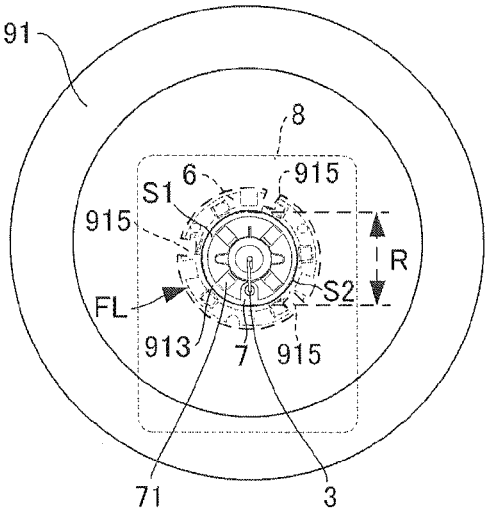

When an area S1 of the metal part 7 exposed from the reflector 91 was 400 $mm^2$ or less when viewed from the front end side shown in FIG. 11B, occurrence of glare could be suppressed. The glare occurred because the light emitted from the light emitting part 11 was reflected by the metal part 7, the protruding piece part 71 or the sleeve holding part 72 which were exposed from a hole of the reflector 91 having a diameter R.

The glare occurred when the area S1 was 500 $mm^2$ and 450 $mm^2$ respectively, sufficiently suppressed when the area S1 was 400 $mm^2$ and did not occur when the area S1 was 350 $mm^2$, 300 $mm^2$ and 250 $mm^2$ respectively. Accordingly, it is preferable that the area S1 be 400 $mm^2$ or less, more preferable that the area S1 be 350 $mm^2$ or less. In addition, the area S1 maybe adjusted by the diameter of the hollow of the metal part 7 and by the width of the protruding piece part 71. In the example, the diameter of the hollow was 17.8 mm and the width of the protrusion part was 3.5 mm.

In addition, since the resin part 6 is degraded by the heat or the ultraviolet light and then the gas is easily released when the resin part 6 is exposed from the hole of the reflector 91, it is preferable that an area S2 of the resin part 6 which is exposed from the reflector 91 viewed from the front end side be 50 $mm^2$ or less.

(Second Embodiment)

Figure 8:
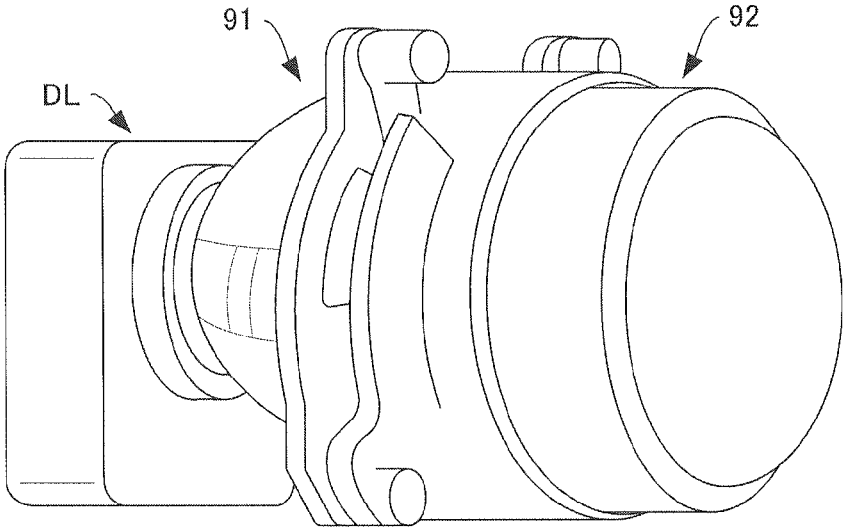
FIG. 8 is a view explaining a discharge lamp apparatus of a second embodiment of the present invention.

FIG. 8 is a view explaining a discharge lamp apparatus of the second embodiment of the present invention. The same part of the second embodiment as the discharge lamp of the first embodiment is indicated by the same reference numeral and the description thereof is omitted.

The discharge lamp apparatus is configured of a reflector 91, a lens configuration body 92 and a discharge lamp DL.

Figure 9:
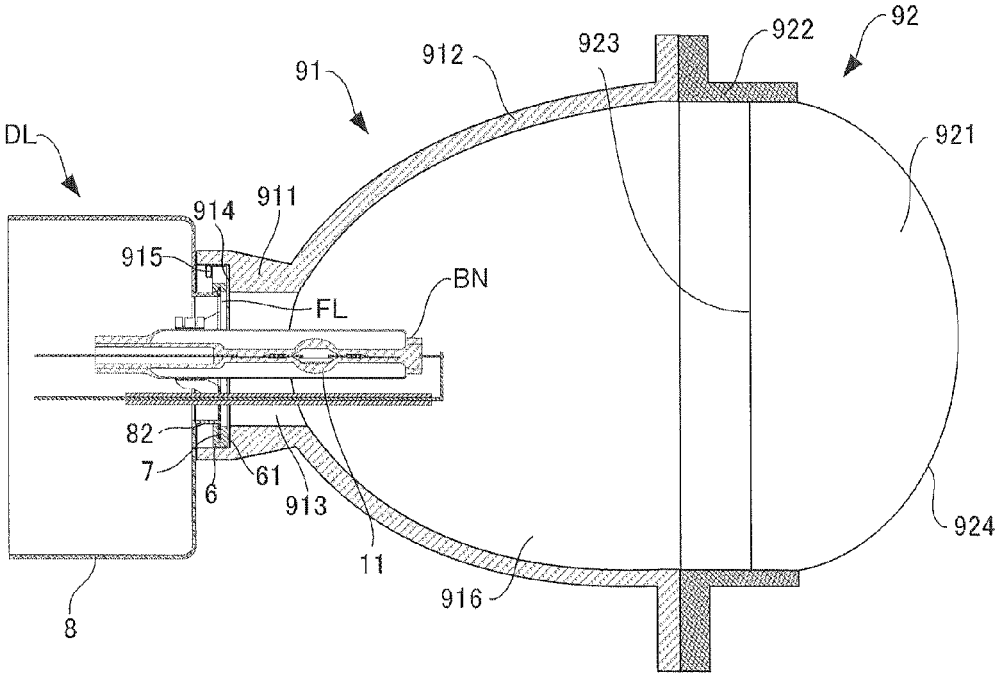
FIG. 9 is a view explaining a cross-section of the discharge lamp apparatus of FIG. 2.
Figure 10:
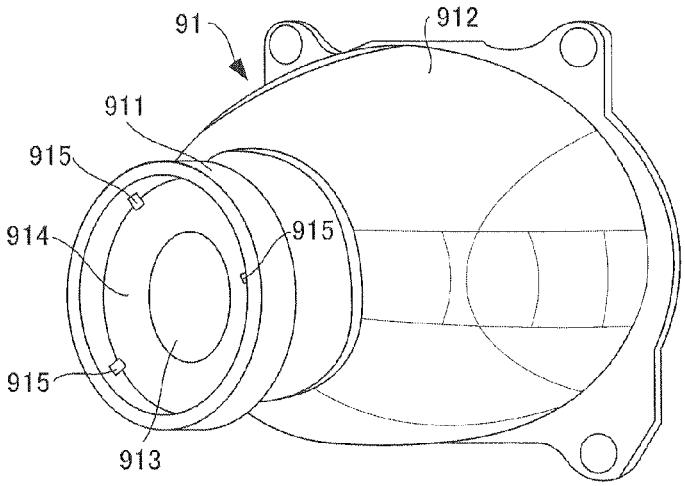
FIG. 10 is a view explaining a reflector.

As shown in FIGS. 9 and 10, the reflector 91 is configured of a neck part 911 and a reflection part 912.

An inner wall part of the neck part 911 is formed as a shape having a step, that is, a space 913, of which the shape is changed, is formed inside of the neck part 911. In addition, the contact surface 914 is formed at the stepped portion which is positioned at back end side of the neck part 911. As shown in FIG. 10, the contact surface 914 is formed in an annular shape. Furthermore, three engaging pieces 915 are formed at the inside of the neck part 911 at back end side from the contact surface 914.

The reflection part 912 is formed continuously with the front end side of the neck part 911 and a space 916 communicating with the space 913 is formed at the inside thereof.

The lens configuration body 92 is configured of a lens 921 and a lens holding part 922, and is disposed at an opening portion of the reflector 91. The lens 921 is a lens which allows the light emitted from the opening of the reflector 91 to be entered from a light incident surface 923 and to be emitted from a light output surface 924. The shape of the lens 921 may be variously modified according to a desired light distribution.

The discharge lamp DL is the lamp described in the first embodiment and is connected to the reflector 91 so that the burner BN, and specifically, the light emitting part 11 is disposed at the space 913 or the space 916.

The contact between the discharge lamp DL and the reflector 91 is described with reference to FIGS. 11A and 11B.

First, as shown in FIG. 11A, the discharge lamp DL is moved so that three protuberance parts 61 of the resin part 6 come into contact with the contact surface 914 formed at the back end side of the neck part 911 while matching three engaging pieces 915 with three cutout parts 74 of the flange FL.

Next, the discharge lamp DL is rotated by a degree (for example, 20 degrees) around the tube axis so that the position of the sleeve 3 moves downward in the drawing. Then, as shown in FIG. 11B, the resin part 6 of the flange FL is sandwiched between the contact surface 914 and three engaging pieces 915.

Since the resin part 6 may be formed with the resin molding and the dimensional accuracy is excellent, it does not cause such a problem that the resin part 6 cannot be fitted between the contact surface 914 and the engaging pieces 915 due to the dimensional error or the holding thereof is sufficient because of occurrence of the gap. In addition, since the strength of the resin part 6 is excellent, the flange FL is not deformed even though the rotation operation or removal operation is repeated. As described above, the contact between the discharge lamp DL and the reflector 91 can be simply and reliably performed by holding the resin part 6 of the flange FL in the neck part 911.

As shown in FIG. 11B, when the discharge lamp DL is viewed from the opening of the reflector 91, the visible part of the flange FL is only the metal part 7. That is, the resin part 6 is not exposed in the space 913 having the diameter of R (for example, 26 mm). Accordingly, in the state, since the ultraviolet light emitted from the light emitting part 11 is hardly irradiated to the resin part 6 even though the discharge lamp DL is lighted, defects can be suppressed in which the gas or the like occurs due to the degradation of the resin part 6 and the light incident surface 923 of the lens 921 is clouded.

In addition, the lamp, in which the molding width of the resin part 6 is changed, is held in the reflector similarly and is lighted, however, the lens 921 is not whitened even though the resin part 6 is somewhat exposed to the space 913. Therefore, the embodiment of the present invention should not be limited to the state in which the resin part 6 is not exposed at all to the space 913.

(Third Embodiment)

Figure 12:
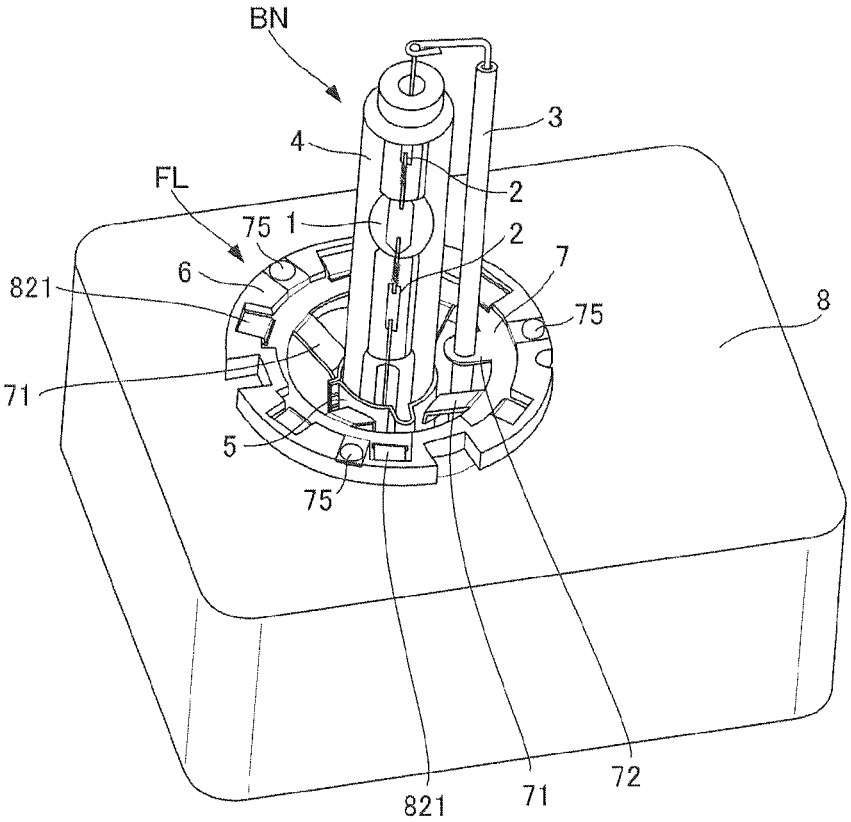
FIG. 12 is a view explaining a discharge lamp of a third embodiment of the present invention.
Figure 13:
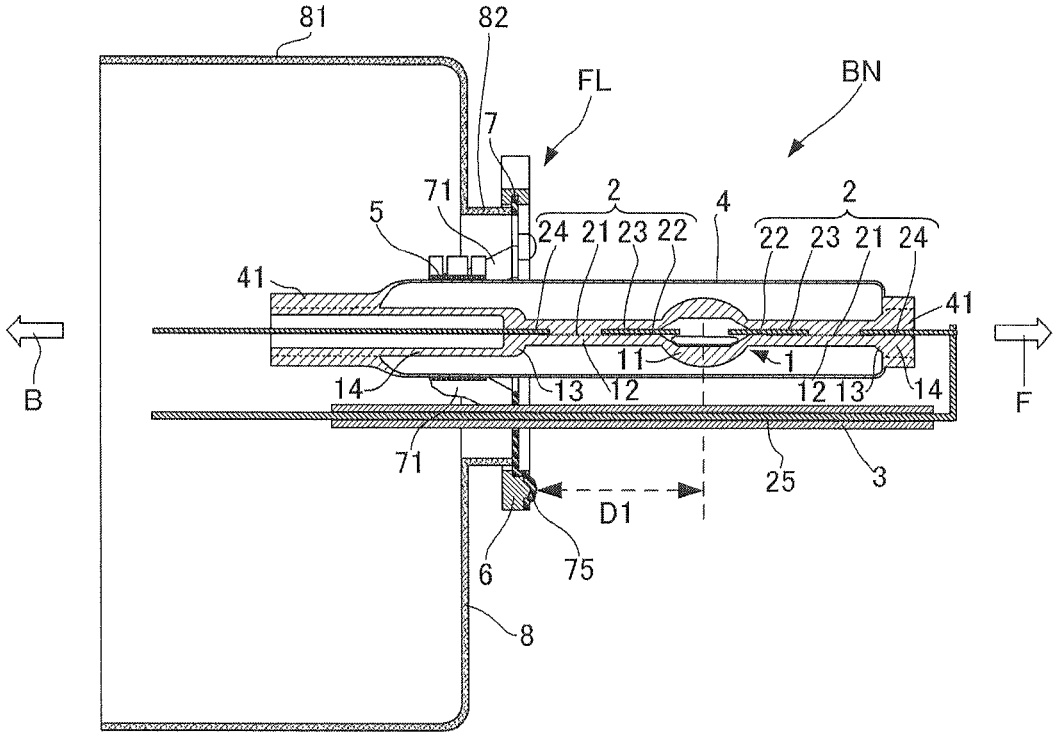
FIG. 13 is a view explaining a cross-section of the discharge lamp of FIG. 12.

FIG. 12 is a view explaining a discharge lamp of the third embodiment of the present invention. In the embodiment, a protuberance part 75 is integrally formed with the metal part 7 and as shown in FIG. 13, the protuberance part 75 is provided so as to protrude from the resin part 6 in the front end direction.

Figure 14:
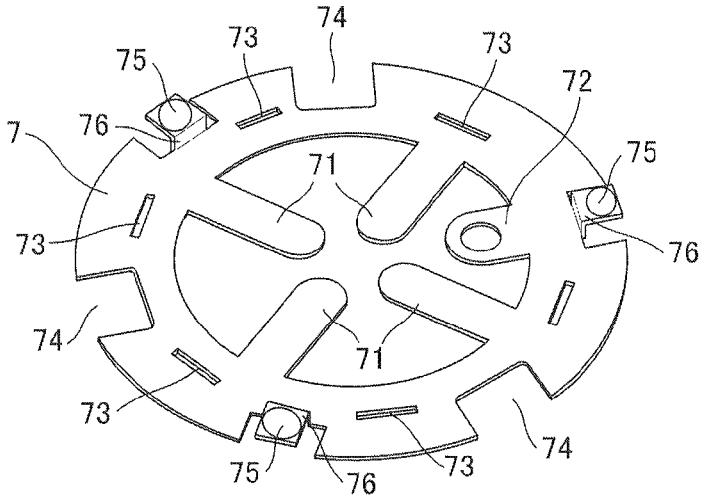
FIG. 14 is a view explaining a metal part.

FIG. 14 illustrates the shape of the metal part 7 of the embodiment before embedded in the resin part 6. The protuberance part 75 is formed on a bending part 76 which is formed by bending. As shown in FIG. 9, when the flange FL is attached to the reflector 91, the protuberance part 75 comes into contact with the contact surface 914 of the reflector 91.

FIG. 15 illustrates a structure of the inside of the base 8 of the discharge lamp. A start lighting circuit IG which is referred to as an igniter and a stability lighting circuit BL which is referred to as a ballast are disposed at the inside of the base 8.

The output side of the stability lighting circuit BL is connected to the input side of the start lighting circuit IG and the output side of the start lighting circuit IG is connected to the lead 24 and the support wire 25 of the discharge lamp. The input side of the stability lighting circuit BL is connected to a DC power supply DS such as a battery via a connector 83 which is formed at the base 8 and is connected to other cables. The minus side of the DC power supply DS is also connected to the base 8. In other words, the base 8 is connected to the ground.

The base 8 is electrically connected to the metal part 7 via the protrusion part 821. Accordingly, the protuberance part 75 is also connected to the ground during lighting. Thus, when the discharge lamp is attached to the reflector, the reflector made of metal is also connected to the ground. Thus, noise, which occurs from the burner BN during lighting, can be reduced by the reflector.

In the embodiment, the protuberance part 75 is provided so as to protrude from the resin part 6 in the front end direction and the protuberance part 75 is electrically connected to the base 8 which is connected to the ground via the metal part 7 so that the reflector is also connected to the ground when the discharge lamp is attached to the reflector. Accordingly, noise, which occurs from the burner BN during lighting, can be suppressed.

In addition, the connection of the reflector to the ground may be performed with a method other than via the protuberance part 75. For example, a metal piece, which is integrally formed with the metal part 7 is provided at the surface of the back end side of the flange FL and the metal piece may come into contact with the engaging pieces 915 in a state where the metal piece is attached to the reflector. Otherwise, the metal piece, which is integrally formed with the metal part 7, is provided at the surface of the side wall of the flange FL and the metal piece may come into contact with the inner surface of the neck part 911 in a state where the metal piece is attached to the reflector. In addition, the base 8 and the reflector maybe connected to each other directly or indirectly. In short, the reflector may be a structure that is connected to the ground using the metal part of the discharge lamp connected to the ground. In addition, the connection of the base 8 to the ground may be performed by connecting the cable including a sealed mesh to the connector 83.

Also in the embodiment, since most of the edge of the flange FL is the resin part 6, the dimensional accuracy and the strength of the flange FL are improved. The thickness of the flange FL is the thickness of the resin part 6 and high dimensional accuracy can be obtained.

(Fourth Embodiment)

FIG. 16 is a view explaining a discharge lamp of the fourth embodiment. In the embodiment, argon gas is sealed in the outer tube and the high-voltage pulse with a positive polarity is applied to the discharge lamp in which the metal band is connected to the ground.

The metal band 5 is mounted on the outer surface of the burner BN, the metal band 5 is held by the protruding piece part 71 integrally formed at the metal part 7, and the metal part 7 is connected to the base 8. In this case, the metal band 5 and the base 8 are electrically connected to each other.

At this time, when the base 8 is connected to the ground as the third embodiment, the metal band 5 is also connected to the ground. When the metal band 5 is connected to the ground, although the effect that noise is improved is obtained, it is found that the startability may be poor.

For example, the gas such as nitrogen is sealed in the inner space 112 of the outer tube 4 and the gas pressure is lower than the gas pressure inside of the discharge space 111 of the inner tube 1. Thus, dielectric barrier discharge occurs in the inner space 112 of the outer tube 4 and the dielectric breakdown is assisted when starting. That is, the light may be reliably emitted with lower discharge start voltage.

However, when the metal band 5 is connected to the ground and the lighting is performed at a usual high-voltage pulse, the startability may be poor. It is considered because dielectric barrier discharge generated in the outer tube 4 when starting occurs toward the metal band 5 due to the connection of the metal band 5 to the ground and auxiliary electrode effect becomes weak without spreading the dielectric barrier discharge.

Figure 17:
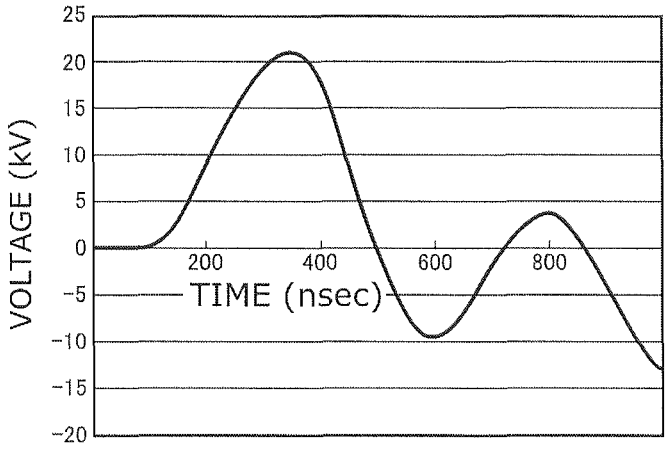
FIG. 17 is a view illustrating the high-voltage pulse with a positive polarity.

FIG. 16 is a view explaining noise and startability when applying the high-voltage pulse with a positive polarity illustrated in FIG. 17, in twelve types of lamps in which the gas sealed in the outer tube and presence or absence of the connection of the protuberance part and the metal band to the ground are changed. In addition, "the high-voltage pulse with a positive polarity" is the pulse which is generated at the positive side just after the pulse is applied. The positive and the negative of the pulse may be changed by the direction of winding of the transformer.

As can be seen from the result, in the lamp in which the protuberance part and the metal band were not connected to the ground, noise occurred but the startability was good regardless of the type of gas except the lamp No. 1 in which the atmosphere which was poor in the startability since dielectric barrier discharge hardly occurred when starting sealed. When the protuberance part and the metal band were connected to the ground, the noise did not occur in any lamp, however, it was understood that the lamp which had poor startability may occur. Since the dielectric breakdown voltage of the lamp No. 4 in which nitrogen was sealed increased approximately 2 kV compared to that of the lamp No. 3 in which the protuberance part and the metal band were not connected to the ground, and the dielectric breakdown voltage of the lamps No. 6, 10 and 12 in which neon, krypton and xenon were sealed respectively increased approximately 1 kV, the start was difficult. Meanwhile, the dielectric breakdown voltage of the lamp No. 8 in which argon was sealed did not nearly increase and the startability was good similar to the lamp No. 7.

As described above, the startability of the lamps No. 4, 6, 10 and 12, in which the protuberance part and the metal band were connected to the ground, was poor and it maybe because the dielectric barrier discharge was not spread to the inner space 112 of the outer tube 4. It should be noted that in the lamp No. 8 in which similarly the metal band was connected to the ground, the startability was good. The reason was not known exactly, however, when argon was sealed in the outer tube, the startability was hardly affected even though the metal band was connected to the ground.

Figure 18:
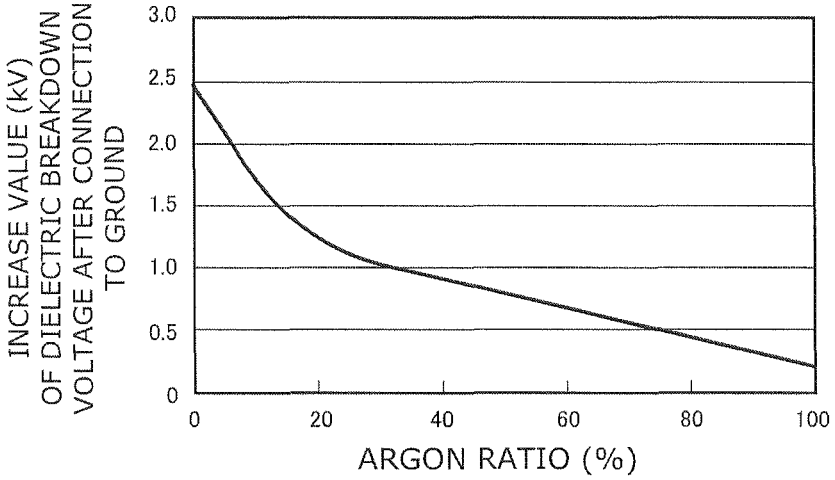
FIG. 18 is a view explaining change of dielectric breakdown voltage when the argon ratio is changed in a mixed gas of argon and nitrogen.

Next, similar text was performed for the mixed gas of argon and nitrogen. The result thereof is shown in FIG. 18. FIG. 18 is a view explaining change of dielectric breakdown voltage when an argon ratio is changed in the mixed gas of argon and nitrogen. In addition, the ratio is a partial pressure ratio (a mole ratio).

As can be seen from the result, the higher the argon ratio, the smaller the increase in the dielectric breakdown voltage, that is, the startability is good. Furthermore, since if the argon ratio is lower than 20%, the dielectric breakdown voltage tends to increase, it is preferable that the argon ratio be 20% or more. In addition, it is preferable that the argon ratio be 75% or more which may suppress the increase in the dielectric breakdown voltage to 0.5 kV or less. In addition, similar result is generated in the mixed gas of krypton, xenon or the like.

In the embodiment, since the protuberance part 75 comes into contact with the reflector made of the metal and then the reflector is connected to the ground by connecting the protuberance part 75 of the metal part 7 to the ground when the lamp is mounted on a lighting appliance, the noise can be suppressed. In addition, the startability can be improved by sealing argon or gas which is mainly composed of argon such as 20% or more, preferably 75% or more in the inside of the outer tube 4, even though the metal band 5 is connected to the ground and the high-voltage pulse with a positive polarity is applied to the burner BN when starting. In other words, a simplified structure, in which the metal band 5 is held by the protruding piece part 71 integrally formed with the metal part 7, is employed so that good startability can be maintained.

In addition, the startability can be further improved by forming a conductive coating on the electrode mount 2, specifically, on the surface of the seal part 12 in which the metal foil 21 is sealed. This is true for the other embodiments. As the conductive coating, tin oxide, indium oxide, zinc oxide, ITO (indium tin oxide) that is indium and tin oxide, or the like may be used.

(Fifth Embodiment)

Figure 19:
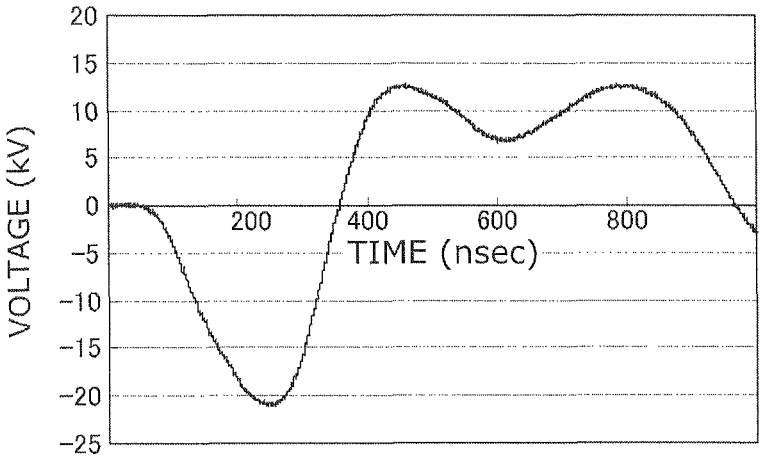
FIG. 19 is a view explaining a discharge lamp of a fifth embodiment of the present invention.

FIG. 19 is a view explaining a discharge lamp of a fifth embodiment of the present invention. In the embodiment, a start pulse with a negative polarity is supplied to the burner BN when starting.

FIG. 20 is a view indicating a relationship between presence or absence of the connection of the metal band to the ground, polarity of the high-voltage pulse which is input when starting, the noise, spread of the barrier discharge in the outer tube and startability.

As can be seen from the drawing, if the metal band 5 is not connected to the ground, the startability is good but the noise occurs regardless of whether the polarity of the high-voltage pulse is positive or negative. When the metal band 5 is connected to the ground, if the polarity of the high-voltage pulse is positive, the noise does not occur but the startability is poor, and when the polarity of the high-voltage pulse is negative, the startability is good and the noise also does not occur.

As described above, even though the metal band 5 is connected to the ground, the noise is suppressed and the startability can be good by applying the high-voltage pulse with a negative polarity when starting. It is confirmed that when the high-voltage pulse with a negative polarity is applied during the start, the startability is good regardless of the type of gas sealed in the outer tube. In other words, the gas sealed in the outer tube is not limited to argon base and the startability can be good even with nitrogen, krypton or the like different from the fourth embodiment so that the effect is better. In addition, "the high-voltage pulse with a negative polarity" refers to the pulse generated on the negative side immediately after the pulse is applied as shown in FIG. 19.

In the embodiment, the metal band 5 mounted along the outside surface of the burner BN is connected to the ground and the noise is suppressed and then the startability can be good by supplying the start pulse with a negative polarity from the start lighting circuit IG to the burner BN when starting.

(Sixth Embodiment)

FIGS. 21A and 21B are views explaining a discharge lamp of the sixth embodiment of the present invention. FIG. 21B is an enlarged cross-sectional view of the resin part 6, the metal part 7 and the protruding piece part 71 in FIG. 21A.

In the embodiment, the protruding piece part 71, which is a unit configured to hold the burner BN, is a part separated from the metal part 7 and the protruding piece part 71 is formed by being embedded in the resin part 6. The edge of the outer periphery side of the metal part 7 is embedded in the front end side in the thickness direction of the resin part 6. The end of the protruding piece part 71 is embedded at the back end side in the thickness direction of the resin part 6 from the metal part 7.

Accordingly, since the metal band 5 and the base 8 are electrically insulated, the startability may not be degraded. Thus, when the sixth embodiment is combined with the third embodiment in which the protuberance part 75 is connected to the ground when lighting, the startability can be good while the noise is suppressed. In other words, the startability can be improved by holding the burner BN to the flange FL using the protruding piece part 71 which is electrically insulated from the base 8.

Several embodiments of the present invention are described, however, these embodiments are presented by way of examples and are not intended to limit the scope of the present invention. New embodiments can be implemented in various other forms. In addition, various omissions, substitutions and changes can be performed without departing from the scope of the present invention. The embodiments or modifications thereof are included in the scope of the gist of the present invention and are also included in scope of the present invention disclosed in the claims and equivalents thereof.

For example, the flange FL is not limited to the configuration which is formed only with the resin part 6 and the metal part 7. In other words, the flange FL is not limited to the configuration which is formed with two parts. In addition, the resin part 6 of the back end side of the flange FL is not limited to the edge and maybe formed near the center thereof. If the resin part 6 is formed at the back end side, it is difficult to irradiate the ultraviolet light directly to the resin part 6 with the metal part 7.

As shown in FIG. 22, the protruding piece part 71 may be protruded to the front end side of the flange FL. In this structure, since the connection portion of the metal band 5 and the protruding piece part 71 is exposed to the front end side of the flange FL, a merit is provided that the welding thereof can be easily performed.

Figure 23:
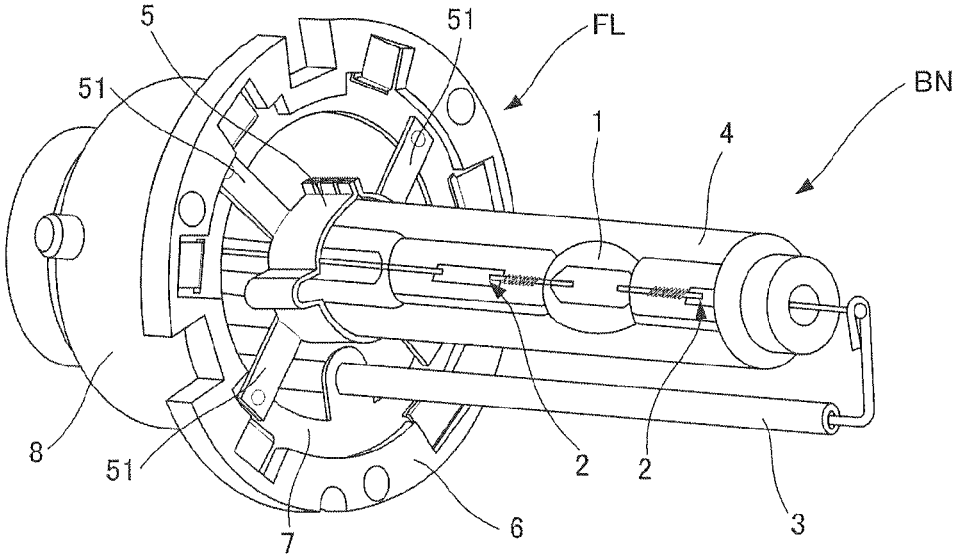
FIG. 23 is a view explaining a second modification example of the discharge lamp.

In addition, as shown in FIG. 23, a protrusion part 51 is integrally formed with the metal band 5, and the protrusion part 51 and the metal part 7 may be connected to each other, for example, by welding. Also in the structure, a merit that the welding between the protrusion part 51 and the metal part 7 may be easily performed is provided.

As shown in FIG. 22 or 23, the base 8 may be a socket type which does not have the igniter or the ballast inside thereof. In other words, the embodiment of the present invention may be applied to a lamp such as a so-called D2 type or D4 type.

The ring 82 of the base 8 may be integrally formed with the case part 81 and the ring 82 and the case part 81 are formed separately and then may be integrated by welding or the like.

The neck part 911 and the reflection part 912 of the reflector 91 are not necessarily in a positional relationship in which the space 913 and the space 916 inside thereof are formed linearly, and the positional relationship may be provided so that spaces are curved.

REFERENCE SIGNS LIST

BN BURNER
1 INNER TUBE
11 LIGHT EMITTING PART
4 OUTER TUBE
5 METAL BAND
FL FLANGE
6 RESIN PART
7 METAL PART
8 BASE
61, 75 PROTUBERANCE PART
71, 51 PROTRUDING PIECE PART
IG START LIGHTING CIRCUIT
BL STABILITY LIGHTING CIRCUIT
91 REFLECTOR
911 NECK PART

914 CONTACT SURFACE
912 REFLECTION PART

The invention claimed is:

1. A discharge lamp apparatus comprising:

a discharge lamp which includes a burner having a light emitting part, and a disk-shaped flange capable of holding the burner so that the light emitting part is positioned at a front end side of the flange, and a reflector which includes a neck part having a contact surface at a back end side, a reflection part formed so as to be continuous with a front end side of the neck part, and a space formed so as to communicate with the inside of the neck part and the reflection part, wherein the flange has a resin part formed at an edge of the flange, and a metal part formed to be embedded in the resin part, and the discharge lamp is held at the reflector so that the burner is positioned in the space and at least a portion of the front end side of the flange comes into contact with the contact surface.

2. The discharge lamp apparatus according to claim 1, further comprising:

a conductive base provided at a back end side of the flange and connected to a ground, and a lighting circuit disposed at the inside of the base.

3. The discharge lamp apparatus according to claim 2, wherein the metal part has a protuberance part formed so as to protrude from the resin part in a direction toward the front end side of the flange, the protuberance part being electrically connected to the base.

4. The discharge lamp apparatus according to claim 2, further comprising:

a metal band mounted along an outer surface of the burner and electrically connected to the base, wherein the lighting circuit supplies a high-voltage pulse with a negative polarity to the burner when starting.

5. The discharge lamp apparatus according to claim 2, wherein the burner is held at the flange by means for holding the burner which is electrically insulated from the base.

* * * * *